US007513406B2

(12) United States Patent
Marks

(10) Patent No.: US 7,513,406 B2
(45) Date of Patent: Apr. 7, 2009

(54) MINI DESKTOP STAPLER

(75) Inventor: Joel S. Marks, Sherman Oaks, CA (US)

(73) Assignee: Worktools, Inc., Chatsworth, CA (US)

( * ) Notice: Subject to any disclaimer, the term of this patent is extended or adjusted under 35 U.S.C. 154(b) by 0 days.

(21) Appl. No.: 11/772,615

(22) Filed: Jul. 2, 2007

(65) Prior Publication Data

US 2008/0149681 A1 Jun. 26, 2008

Related U.S. Application Data

(63) Continuation of application No. 11/614,007, filed on Dec. 20, 2006, now Pat. No. 7,299,960.

(51) Int. Cl.
*B25C 5/06* (2006.01)

(52) U.S. Cl. ..... 227/120; 227/132; 227/134

(58) Field of Classification Search ..... 227/120, 227/8, 136, 119, 132, 134, 127; 267/158, 267/239

See application file for complete search history.

(56) References Cited

U.S. PATENT DOCUMENTS

| | | | |
|---|---|---|---|
| 1,956,174 | A | 4/1934 | Maynard |
| 2,142,782 | A | 1/1939 | Gillette |
| 2,218,794 | A | 10/1940 | Kilbride |
| 2,271,479 | A | 1/1942 | Gambao |
| 2,421,429 | A | 6/1947 | Obstfeld |
| 2,582,062 | A | 8/1952 | Peters et al. |
| 2,657,384 | A | 11/1953 | Boroughs |
| 2,726,391 | A | 12/1955 | Pilblad |
| 2,733,440 | A | 2/1956 | Jenny |
| 2,884,636 | A | 5/1959 | Abrams |
| D186,342 | S | 10/1959 | Marano |
| 2,915,753 | A | 12/1959 | Ruskin |
| 3,034,128 | A | 5/1962 | Robbins |
| 3,630,428 | A | 12/1971 | Olney et al. |

(Continued)

FOREIGN PATENT DOCUMENTS

| | | |
|---|---|---|
| DE | 2856621 | 12/1978 |

(Continued)

OTHER PUBLICATIONS

Packaging: EasyShot Staple Gun & Desktop Stapler, PowerShot, Jan. 2001.

*Primary Examiner*—Scott A. Smith
(74) *Attorney, Agent, or Firm*—Paul Y. Feng; Fulwider Patton LLP

(57) ABSTRACT

A miniature spring-actuated stapler includes a tapered, flat power spring to store energy and eject staples. The power spring pivots at a rear of the stapler housing and includes three co-extensive arms terminating near the striker. As the L-shaped handle of the stapler is pressed, it acts on the center arm of the power spring to deflect it downward while the outer arms deflect upward. The arms are integral at a rear end and the outer arms are linked to the striker at the front. A tapered, flat reset spring disposed generally parallel to the power spring is used to reset the internal action. The housing includes open top and rear areas with the handle providing the enclosure thereof. A base assembly is slidably attached at a bottom of the stapler with an open position exposing a staple-loading chamber.

13 Claims, 5 Drawing Sheets

U.S. PATENT DOCUMENTS

| | | | | |
|---|---|---|---|---|
| 3,758,016 | A | 9/1973 | Olney et al. | |
| 3,943,745 | A | 3/1976 | Paul | |
| D243,148 | S | 1/1977 | Levin | |
| 4,156,499 | A | 5/1979 | Frank | |
| 4,206,863 | A | 6/1980 | Savino | |
| 4,463,890 | A | 8/1984 | Ruskin | |
| 4,546,909 | A | 10/1985 | Ebihara | |
| 4,598,852 | A | 7/1986 | Olesen | |
| 4,650,105 | A * | 3/1987 | Kihara | 227/120 |
| 4,666,075 | A | 5/1987 | Olesen | |
| 4,795,073 | A | 1/1989 | Yamamoto et al. | |
| 4,811,884 | A | 3/1989 | Sato | |
| 5,004,142 | A | 4/1991 | Olesen | |
| 5,335,838 | A | 8/1994 | Harris et al. | |
| 5,356,063 | A | 10/1994 | Perez | |
| 5,505,363 | A | 4/1996 | Green et al. | |
| 5,699,949 | A | 12/1997 | Marks | |
| 5,715,982 | A | 2/1998 | Adachi | |
| 5,765,742 | A * | 6/1998 | Marks | 227/132 |
| 5,816,470 | A | 10/1998 | Plato et al. | |
| D413,239 | S | 8/1999 | Lovegrove et al. | |
| 5,931,364 | A | 8/1999 | Dennis | |
| 5,979,736 | A | 11/1999 | Edeholt | |
| 5,988,478 | A | 11/1999 | Marks | |
| 6,102,382 | A | 8/2000 | Labesky | |
| 6,145,728 | A | 11/2000 | Marks | |
| 6,152,347 | A | 11/2000 | Wilson et al. | |
| D437,754 | S | 2/2001 | Jacquet | |
| 6,286,745 | B1 * | 9/2001 | Ackeret | 227/76 |
| 6,918,525 | B2 | 7/2005 | Marks | |
| 7,080,768 | B2 * | 7/2006 | Marks | 227/120 |
| 7,121,444 | B2 * | 10/2006 | Joyce | 227/132 |
| 7,124,922 | B2 * | 10/2006 | Marks | 227/8 |
| 7,243,832 | B2 * | 7/2007 | Jiang | 227/120 |
| 7,299,960 | B1 | 11/2007 | Marks et al. | |
| 7,387,227 | B1 * | 6/2008 | Jiang et al. | 227/8 |
| 7,395,955 | B2 * | 7/2008 | Zins et al. | 227/132 |
| 7,404,507 | B2 * | 7/2008 | Marks | 227/132 |
| 2005/0139631 | A1 | 6/2005 | Marks | |
| 2006/0191972 | A1 | 8/2006 | Marks | |

FOREIGN PATENT DOCUMENTS

| | | | |
|---|---|---|---|
| DE | 19712849 | A1 | 10/1998 |
| DE | 10138447 | A1 | 7/2003 |
| DE | 10225816 | A1 | 1/2004 |
| GB | 2032327 | A | 5/1980 |
| GB | 2229129 | A | 9/1990 |

* cited by examiner

MINI DESKTOP STAPLER

CROSS-REFERENCE TO RELATED APPLICATIONS

This application is a continuation application of U.S. application Ser. No. 11/614,007, filed Dec. 20, 2006, now U.S. Pat. No. 7,299,960, whose entire contents are hereby incorporated by reference.

FIELD OF THE INVENTION

The present invention relates to spring-actuated staplers for fastening paper. More precisely, the present invention relates to a design for a miniaturized stapler.

BACKGROUND OF THE INVENTION

Spring powered staplers and staple guns operate by driving a striker with a power spring. The striker ejects a staple by impact blow. In a desktop stapler, the staple is ejected into an anvil of a normally pivotably attached base. Two general principles for spring-actuated staplers are used. In the first design, the striker has an initial position in front of a staple track. The striker is lifted against the force of the power spring to a position above the staple track. The striker is released to impact and eject the staple. This design may be referred to as a "low start" stapler. A second design uses a "high start" position. That is, the striker has an initial position above the staples loaded on the staple feed track. The power spring is deflected while the linked striker does not materially move. At a predetermined position of the power spring deflection, the striker is released to accelerate into and eject a staple.

Typical desktop staplers use a non-spring powered high start design. In such conventional high start designs the striker is driven directly by the handle with no power spring to store energy that could be used to drive the striker. There is further no release mechanism for the striker since the striker simply presses the staples directly under handle pressure.

In conventional high start designs that do use a power spring, the power spring is either unloaded or preloaded in the rest position. Different methods are used to reset the mechanism. U.S. Pat. No. 4,463,890 (Ruskin) shows a desktop stapler with a preloaded spring. Restrainer 42*c* is an element of the handle and moves directly with the handle. Swiss Patent No. CH 255,111 (Comorga AG) shows a high start staple gun with the handle linked to the power spring through a lever. There is no preload restrainer for the power spring so the spring stores minimal energy through the start of the handle stroke. Both devices use a releasable link or release latch that is positioned behind the striker and de-linked by a direct pressing force from the handle. British Patent No. GB 2,229,129 (Chang) appears to show a high start stapler design. However, no functional mechanism to reset the striker is disclosed. Specifically, no linkage is described to lift the striker with the handle in a reset stroke. The lever 3 resembles a lever used in a low start stapler, but the lever does not lift the striker in any way. Instead, the striker is somehow lifted by a very stiff reset spring, yet no linkage is described to enable a reset spring to lift the striker against the force of the power spring.

Some improvements to a high start stapler are among those disclosed in co-pending U.S. patent application titled "High Start Spring Energized Stapler," filed on Jan. 20, 2006, Ser. No. 11/343,343, by Joel S. Marks, whose entire contents are hereby incorporated by reference. A high start design may be more compact vertically than a low start design and for this reason may be more preferable for use in a miniature stapler. One reason is that in a high start, typically no lever structure is needed to lift the striker so respective lever engaging slots or features are not needed in the striker. The striker and surrounding housing structure can therefore be of minimal height.

A miniature stapler of any type may be defined as one with an overall length of about three and one half inches or less, having a height of about two and one half inches or less and with a capacity for a one to two inch long rack of staples, equivalent to about 50 to 100 standard desktop staples. However, any stapler that fits less than a full standard four-inch long rack of staples may be considered miniature.

In non-spring actuated type staplers, miniature staplers are known. In a conventional, direct action miniature stapler, the usable pressing area of the handle is about thumb sized. A typical 15 lbs. or more force is required to operate such a direct action stapler to staple through, for example, two or more pages. Needless to say, it is difficult or uncomfortable for a user to apply or squeeze with such force using only a thumb. It is therefore desirable to have a miniature stapler that is suited for squeezing by thumb pressure while requiring a reduced actuation force of less than 15 lbs. For example, a force of 5 to 12 lbs. as measured by a user applying pressure on the handle pressing area is preferred through most of the handle actuation stroke to staple through 2 to 10 pages of paper.

SUMMARY OF THE INVENTION

The present invention provides for a compact, efficient, spring-energized miniature stapler. In a preferred embodiment, squeezing merely with fingers operates the stapler. The stapler preferably has a capacity of 2-10 pages, but more pages may be stapled in one stroke depending on the thickness of the paper and the particular design of staples. As for the latter, the strength of glue used to bind a rack of staples together affects stapler performance since a staple must be sheared off the end of the rack by the striker in order to eject the staple. If the glue is strong, the power spring must provide the striker with enough energy to overcome the stapler glue and shear off that staple by a single impact blow. Empirical testing has shown that a staple rack with strong glue may allow for up to 8 page stapling, while a weaker glue leaves more energy available to staple as many as 14 pages or more.

In a preferred embodiment of the present invention, the stapler is short lengthwise and minimally tall yet still substantially fits the internal spring-powered action and the necessary handle travel to energize and fire the stapler. The present invention stapler design is preferably a high start type since this is generally more compact vertically as compared to a low start type. With a small size, the spring powered stapler of the present invention is comfortable to carry and store. If it is clipped to a backpack, belt or other article that is worn, it will not swing or bang around as a conventionally sized stapler would. It also will easily fit into a typical jacket or pants pocket, or in a purse. The stapler includes a narrow body shape that allows it to hang or store unobtrusively.

In a preferred embodiment, a spring-actuated mechanism of the present invention fits within a housing body similar in size to conventional direct action staplers having miniature proportions. The power spring stores user applied energy and suddenly releases that energy via accelerating a striker which ejects a staple by impact blow. In a preferred embodiment, the power spring is a flat spring having co-extending resilient arms cantilevered from a common mounting. Such a spring provides an effective stapler function in a short and vertically compact package. The power spring includes an upper position immediately adjacent to a top wall of the housing, and a lowest position against an absorber abutting a staple chamber.

Furthermore, the reset spring that returns the action to its initial start position is preferably also a flat spring similar to the power spring, again to save space in the vertical direction. Thus, the preferred embodiment stapler employs two flat springs arrange generally in parallel within the housing, giving the stapler spring powered action while maintaining vertical compactness. Of course, a coiled torsion spring may optionally be used in place of a flat reset spring if the coils are of sufficiently small diameter.

In a preferred embodiment of the present invention stapler, a handle is pivotably attached to the body. When viewed from the side, the handle may be hinged at a lower rear corner or position of the stapler body while the pressing area is at a diagonally opposite front, top corner. The handle is thus hinged beneficially as far as practical away from the pressing area of the handle. In this way, the effective handle length is maximized within the confines of a miniature stapler. During a pressing stroke, a user's fingers are sufficiently distant from the hinge to provide useful leverage without excessive angle changes of the pressing area.

Staples may be loaded into a chamber at the bottom of the stapler. To expose the staple chamber, the base slides rearward along with the staple holding track. Optionally, pivoting the base to an open position with or without sliding of the track/base sub-assembly may also expose the chamber. The sliding and pivoting action may operate together. In a further alternative embodiment, the track may extend forward under the striker to load the staples.

The base includes a normally slightly open position below the body to enable insertion of papers. The base is pressed to a fully closed position as it is squeezed or pressed during normal operation. A bias spring holds the base in the slightly open position.

DETAILED DESCRIPTION OF THE PREFERRED EMBODIMENTS

The present invention in various exemplary embodiments is directed to a spring powered stapler with miniature proportions. Such a miniature spring powered stapler is smaller in overall size and has a smaller staple capacity for convenient portability and low weight yet still functions as a full sized, direct action or spring powered stapler. For example, office workers who travel and perform their tasks en route in an airplane, in a car, at the hotel, or at any locale remote from the home office can use the spring powered miniature stapler for significant paper and like stapling jobs without having to lug around a bulky and heavy desktop stapler. Realtors, school teachers, students, sales reps, and the like who may work outside of an office environment might not have ready access to a full sized desktop stapler can also enjoy the diminutive, pocket size portability, low weight, and convenient access of the present invention stapler. The present invention stapler is also a valuable tool within an office environment for normal everyday use.

Moreover, the spring-powered action of the miniature stapler generates sufficient power to staple multiple sheets, yet is small enough to fit in the hand of schoolchildren. Such users who could not generate sufficient finger pressure to operate a conventional direct action stapler of similar proportions can now benefit from the spring-powered action in the present invention stapler, which requires much lower applied hand pressure to work.

Figure 31:
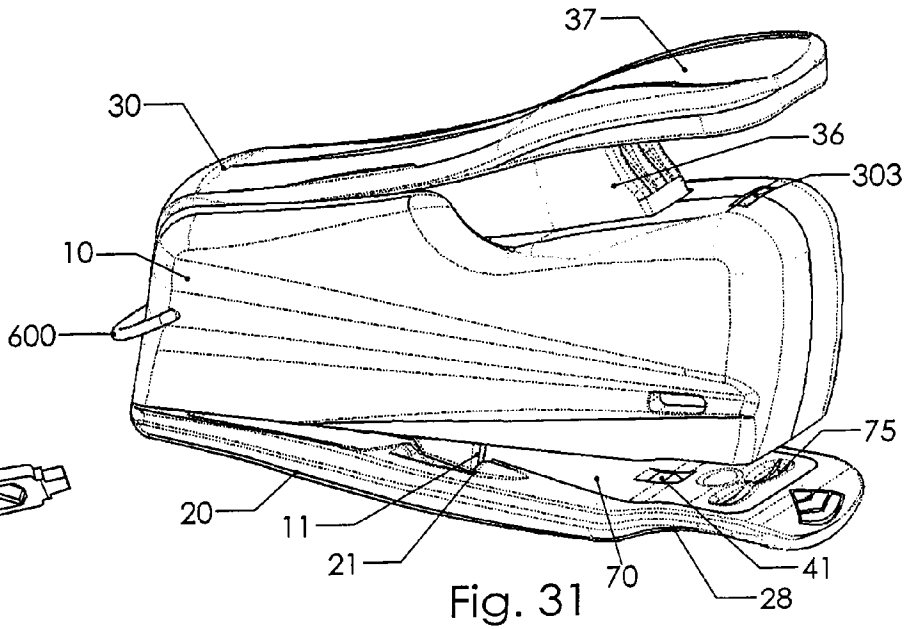
FIG. 31 is a side, front perspective exterior view of the preferred embodiment stapler.

FIG. 31 is a side, front perspective view of a preferred embodiment spring-powered, miniature stapler. The stapler has an elongated body housing 10 with handle 30 and base 20 both pivoted at the rear end of the housing 10. Staples are ejected downward and out from the front of housing 10 toward anvil 75 when pressing area 37 is pressed sufficiently by the user. Notably, the exterior surfaces of the present invention miniature stapler is preferably smooth and sleek without protrusions or sharp angles, and together with its narrow width, the stapler can be tucked away in a pocket, purse, suit case, backpack, or brief case without snagging, catching, or occupying a lot of space.

Figure 1:
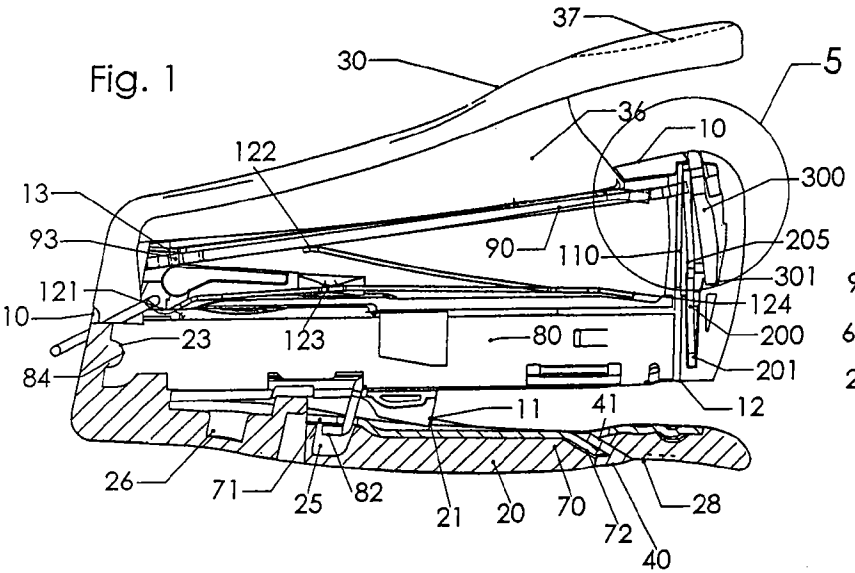
FIG. 1 is a side elevational view of a preferred embodiment stapler in a rest position according to the present invention. A right housing half is removed to expose the interior.

FIG. 1 provides a side elevational view of a preferred embodiment stapler in a rest position. A right housing half is removed to expose the interior. The present invention miniature stapler includes body housing 10 to contain and support further components including handle 30, base 20, power spring 90, and staple track 80. Body 10 preferably includes a separately made left and right halves or sides joined into a single housing assembly to contain and support the components of the stapler. In most of the assembly views, the right housing half is removed for clarity.

Striker 110 moves vertically within channel 11*a* at the front of housing 10. Staple track 80 fits within chamber 14 of housing 10 (FIG. 15) to hold and guide staples (not shown) toward channel 11*a* holding striker 110. Other known track structures may be used to guide staples toward the striker.

The spring powered stapler of the present invention is preferably a high start type, wherein striker 110 includes a rest position (FIGS. 1, 4, 5) above track 80. In an alternative embodiment, a low start design (not shown) may be used wherein the striker has a rest position in front of the staples held in track 80.

Housing 10 and handle 30 may be made from ABS, polycarbonate, or other plastics, fiberglass, ceramics, sheet metal assemblies, die cast zinc, aluminum, or the like. If the housing is made from two halves, separate fasteners such as screws, clamps, clips, roll pins, rivets, or adhesives, soldering, and/or welding may join them together.

Figure 2:
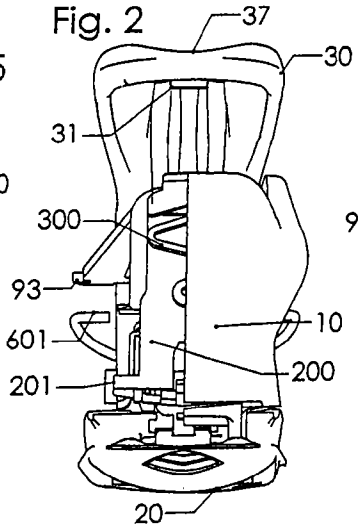
FIG. 2 is a front elevational view of the stapler of FIG. 1.
Figure 4:
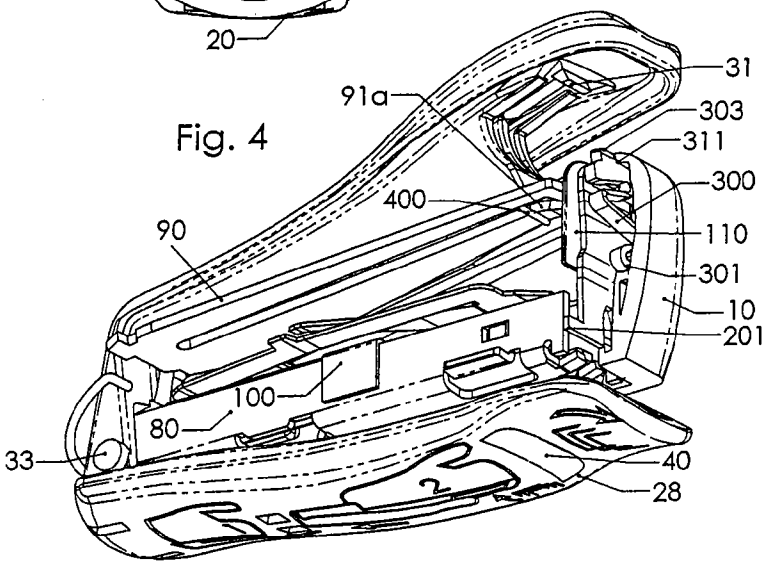
FIG. 4 is a bottom, side perspective view of the stapler of FIG. 1.
Figures 13, 14, 14A, 15, 16, 17, 17A:
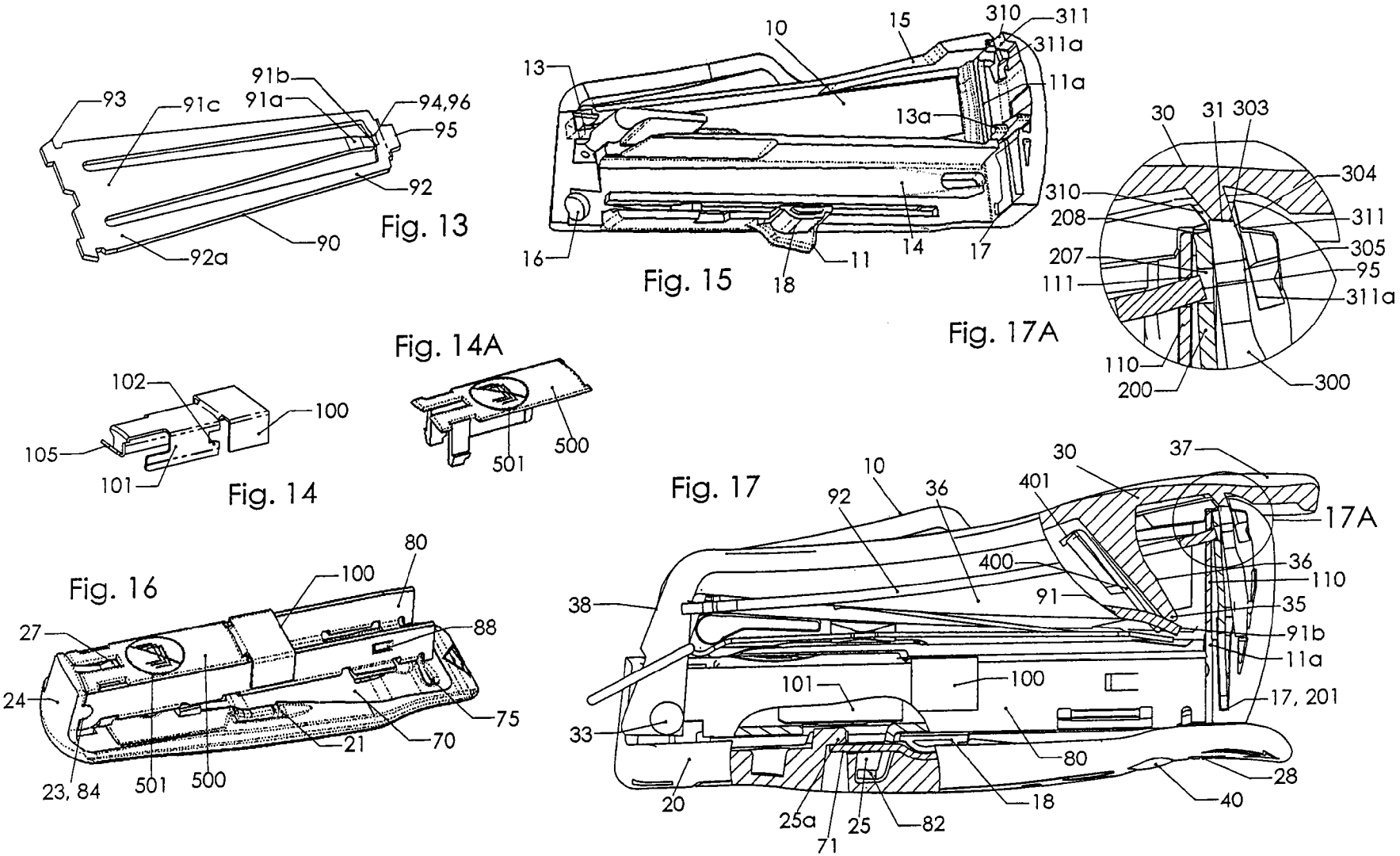
FIG. 13 is a top perspective view of a flat power spring.
FIG. 14 is a top, rear perspective view of a stapler pusher.
FIG. 14A is a top, rear perspective view of a track guard.
FIG. 15 is a side perspective of the left housing half exposing the interior.
FIG. 16 is a top perspective view of a stapler base sub-assembly.
FIG. 17 is a side elevational view of the stapler of FIG. 1 in a power spring stressed, pre-release condition, including two partial cross-sections.
FIG. 17A is a detail view of an upper, front area of the stapler of FIG. 17.
Figures 18, 19, 19A, 20, 21, 22, 23, 23A:
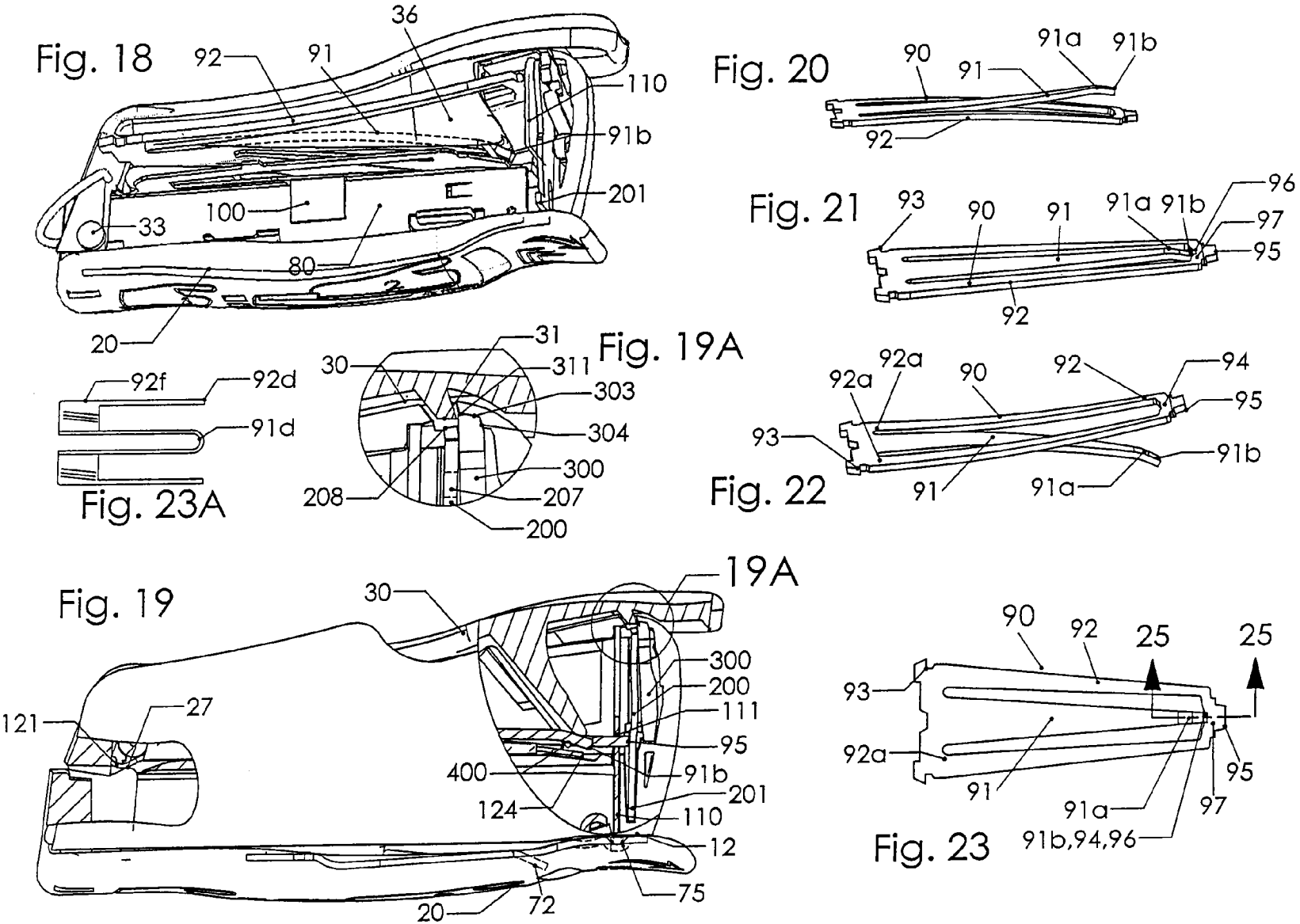
FIG. 18 is a side, lower perspective view of the stapler of FIG. 17.
FIG. 19 is the stapler of FIG. 18, in a configuration after ejection of a staple.
FIG. 19A is a detail view of an upper, front area of the stapler of FIG. 19.
FIG. 20 is a side perspective view of a flat power spring in a free position.
FIG. 21 is the power spring of FIG. 20 in a rest shape corresponding to the condition in FIGS. 1, 4, 6, 7 and 19.
FIG. 22 is the spring of FIG. 20 in a pre-release, stressed shape corresponding to the condition of FIGS. 17 and 18.
FIG. 23 is a plan view of the power spring of FIG. 20.
FIG. 23A is a schematic view of an alternative embodiment double torsion coiled power spring.

In operation, handle 30 is pressed by the user toward housing 10 from its initial, handle highest, pre-power spring stressed position of FIG. 1 toward the handle lowest, staple ejected position of FIG. 19. Normally, holding the stapler and squeezing in one hand operates the stapler. Base 20 may optionally be shaped to allow the stapler to normally rest on a table top for operation by pressing handle 30. A thumb may be placed on pressing area 37 on handle 30, which area may be optionally indented (FIG. 31). Indented pressing area 37 is preferably elongated, with a concave shape extending from a front of handle 30 toward the rear as seen in FIGS. 2 and 31. The index finger or other finger is placed under base 20 at optional concave contour 28 (FIGS. 4, 31). Concave contour 28 is preferably concave as viewed in a width direction of base 20 as seen in FIG. 17, and convex as viewed along a length direction as seen in FIG. 2. In a preferred embodiment, concave contour 28 is substantially vertically aligned below pressing area 37. When gripped in this manner, the stapler is convenient and ergonomically efficient to operate. The placement of handle indent at pressing area 37 and base contour 28 is intended to suggest to the user to hold the stapler in this manner. Empirical testing has shown this design to be effective in communicating this preferred gripping method. A further advantage of handle indent at pressing area 37 and base contour 28 is a reduced grip distance around the stapler. This reduced grip distance provides ergonomic benefits and improved leverage for the user's fingers. A pressing area, with or without an indent at area 37, may extend rearward about 1-¼ inch from a front distal end of handle 30.

Cover holder 40, discussed later, includes an optional, visually distinct surface at the underside of base 20 (FIGS. 3, 4) to further invite gripping in this area by the user. Cover holder 40 may be made of an elastomeric material to provide a non-slip gripping surface. Housing 10 may include recess 12 near the lowermost end of channel 11*a* (FIGS. 1, 19). This recess 12 may cooperate with base contour 28 to enhance the possible upward extent of contour 28. In FIG. 1, it is seen that cover plate 70 of the base sub-assembly (FIG. 16) includes an upward jog. This jog extends slightly into recess 12 in the squeezed configuration (FIG. 19) where cover plate 70 normally contacts the bottom of the housing or track 80.

Figure 3:
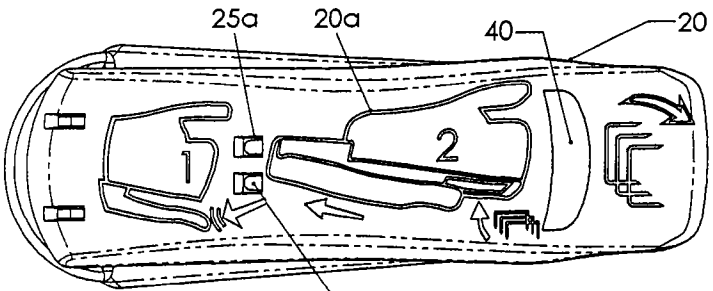
FIG. 3 is a bottom view of the stapler of FIG. 1.

Base 20 also includes optional informational-related graphics, pictograms, and/or instructions 20*a* (FIG. 3) for the benefit of the user. Specifically, FIG. 3 shows a pictogram 20*a* on base 20; the pictogram depicts in step 1 how to begin sliding the track open, and in step 2 the stapler in profile with the staple track slid back to expose staple chamber 14, and an arrow indicating how the staples are to be loaded into the staple chamber. A further image at the top, front of base 20 (FIG. 6) indicates an area to press to open staple track 80. The operation of the staple track is discussed below.

Potential energy generated by the user pressing down on handle 30 is stored in power spring 90 (FIGS. 1, 4, 20-23). Power spring 90 is preferably an elongated flat spring, rotatably fitted at spring rear 93 to pivot 13 (FIG. 15) of housing 10. That is, power spring 90 rotates about pivot 13 at rear 93 while striking out an arc at the front spring tip 95 during each down-up stroke of striker 110 to which it is linked.

More preferably, the location of pivot 13 is located on an imaginary horizontal plane that bisects the arc swept by spring tip 95 into equal angles or the up-down travel limits of striker 110 inside channel 11*a* so that they are equidistant from that horizontal plane as in FIG. 1. The arrangement is essentially an isosceles triangle with the two equal length sides of the triangle corresponding to the highest power spring position (FIG. 1) and the lowest power spring position (FIG. 19) and the third triangle leg corresponding to channel 11*a*. This geometric arrangement of power spring pivot 13 relative to striker 110/channel 11*a* provides the most efficient energy storage and transfer in the power spring by minimizing front-to-back travel that results from the arcing motion of spring tip 95 within slot 111 of striker 110.

As seen in FIGS. 13, 20-23, preferred embodiment power spring 90 is flat and has multiple forward cantilevered arms wherein center arm 91 extends in between outer arms 92. The arms 91, 92 are connected together at or near rear end 93 of power spring 90, near respective proximal areas 91*c* and 92*a* (FIG. 13). In the exemplary embodiment, power spring 90 is die cut from sheet metal spring material, so the proximal area connection 91*c*, 92*a* of arms 91, 92 is inherently integral in the single sheet of material from which spring 90 is cut, requiring no additional components or fabrication steps.

FIGS. 20-23 depict various fabrications steps used to create the preferred embodiment power spring 90. In the plan view of FIG. 23, a planar blank to be formed into power spring 90 has been punched from a single sheet of spring steel wherein two elongated slots are also formed to create the general form for center and outer arms 91, 92. The base of the two elongated slots are rounded to reduce stress near the proximal areas 91*c*, 92*a* of arms 91, 92. A lancing or shearing operation detaches and frees distal end 91*b* of center arm 91 to assume its cantilevered configuration. Preferably, once distal end 91*b* is free, center arm 91 is bent out of plane relative to outer arms 92. Center arm 91 is bent upward and outer arms 92 are bent oppositely, or downward to assume the configuration of FIG. 20. At this free position during the manufacturing stage of power spring 90, the spring has not been preloaded with stress yet. Optional heat treating may be interspersed with the cold work cutting and forming steps, for example, at the stage depicted in FIG. 20.

Power spring 90 may be pre-stressed or preloaded before or after the lancing or shearing step at edge 94. The resulting internal preload means that distal end 91*b* has an upward bias against edge 94 in the rest position of FIGS. 21, 25, while the spring is preferably flat overall in shape since the forces on center arm 91 and outer arm 92 cancel each other. This preload is preferably about 5 to 6 lbs., with a possible range of about 1 to 10 lbs. inclusive of all values therebetween and at the limits. As mentioned above, the preload may be provided by bending the spring after shearing at distal end 91*b* until it assumes the free shape of FIG. 20. In this case, center arm 91 is preferably forced upward during the shearing process. Distal end 91*b* of enter arm 91 is then moved to below edge 94 and a "coining" operation, described in more detail below, locks distal end 91*b* in position.

If the shear on center arm 91 was in the downward direction, there is likely interference at edge 94 with distal end 91*b* due to some small distortion in material creating an overhang. Distal end 91*b* may bypass the pre-existing interference with edge 94 if center arm 91 with end 91*b* above edge 94 is forcibly moved sideways (up or down in FIG. 23, in or out of page in FIG. 25). Distal end 91*b* may thus move around the overhang at edge 94, and center arm 91 can be bent or cold formed into the free shape of FIG. 20. Next, center arm 91 is pushed sideways again and down past edge 94 against the internal bias now in center arm 91 to assume the shape of FIG. 25, which adds the preload to power spring 90.

Figure 25:
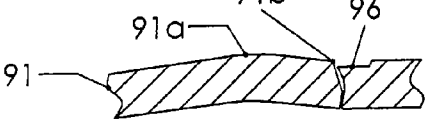
FIG. 25 is a partial cross-sectional view of the center tip area of the power spring of FIG. 21 in the rest shape.
Figure 32:
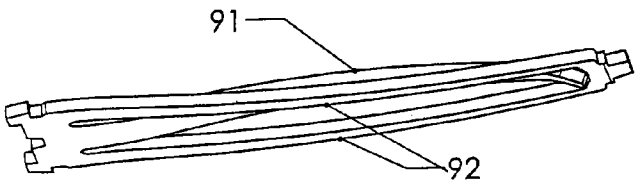
FIG. 32 is a bottom, side perspective view of a power spring during a pre-stressing fabrication operation.

Another way to create the power spring preload is to stress outer arms 92 and center arm 91 while in the rest position of FIG. 25. Distal end 91*b* remains adjacent to edge 94. FIG. 32 shows a possible shape the power spring may take during such a pre-stressing operation. A forming tool forces the spring to bend, and then releases it. If the outer arms and center arm are bent in a suitable manner, the opposing forces are equal and the power spring will resume the flat rest shape of FIG. 21, but with the pre-load present. Empirical testing has shown this pre-stressing method for the power spring to work.

FIG. 21 shows a locked, stressed position of power spring 90 after the manufacturing process is completed. Here, distal end 91*b* of center arm 91 is locked, captured, or selectively linked in one direction, under edge 94 of an interior of power spring 90. Edge 94 is the back part of connecting end 97 (FIGS. 21, 23). Arms 91 and 92 are preferably substantially co-planar in the stapler rest position, or equivalently at least co-linear (at a similar height within the stapler) toward the distal end of center arm 91 in the area of power spring 90 near striker 110. Optional local bends such as 91*a* in FIG. 21 may be formed in the spring in this area. FIG. 21 therefore depicts a preloaded configuration of power spring 90 since distal end 91*b* has been pushed back under edge 94 against the spring bias urging distal end 91*b* toward its up position of FIG. 20. The preloaded power spring 90 is shown assembled inside housing 10 when the stapler is in its rest position in FIGS. 1, 4 and 7. Thus, power spring 90 is preloaded with stress even before the user applies any pressure on handle 30, wherein that preload allows a relatively gradual increase in force through a handle stroke. In contrast, a non-preloaded spring starts with a near zero force and thus requires a rapid force increase to provide useful stapling energy since the early portion of the stroke creates little energy in the spring.

Figure 26:
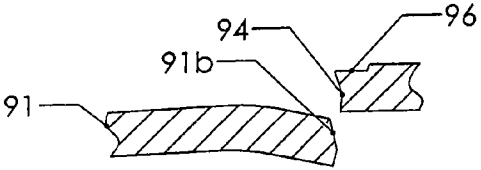
FIG. 26 is a partial cross-sectional view of the center tip area of the power spring of FIG. 21, in a slightly deflected shape.

Various fabrication methods may be used to lock or catch distal end 91*b* of center arm 91 under edge 94 against the preloaded bias in center arm 91. FIGS. 25 and 26 illustrate one method in cross-sectional views of the power spring front end near distal end 91*b*. As generally described above, power spring 90 may be formed by die punching the general shape with the two slots of FIG. 23. Distal end 91*b* and edge 94 may initially be an integral, continuous and unbroken portion of the spring. During or after the initial punching, bend 91*a* is created. Then the spring is sheared or lanced to separate end 91*b* from edge 94. During the shearing step, the part may assume the shape of FIG. 26, as distal end 91*b* of center arm 91 is momentarily pushed down beneath edge 94. Distal end 91*b* and center arm 91 then return to the shape of FIG. 25 because of the internal preload biasing the arm back upward. Optionally, the preload may be added after shearing according to the method of FIG. 32 discussed above.

During the shearing step, some material is distorted by the cutting tool and this distorted material usually flows into an overhang, ledge, or like interfering structure at the upper portion of edge 94 (FIGS. 25, 26). The resulting interfering structure conveniently locks or captures distal end 91*b* of center arm 91 in position at or under edge 94. Thus, center arm 91 cannot move above edge 94. The sequence of these steps may be changed, of course, in various alternative embodiments.

Another way to lock or capture distal end 91*b* of center arm 91 under edge 94 is to press or "coin" edge 94, as depicted by the indented or coined surface 96, and as a result of flattening the coined surface 96 in turn pushes material sideways to create a small overhanging ledge in FIGS. 25, 26. Distal end 91*b* can be similarly pressed or coined to create a small, extended tab or ledge of material (not shown). By the coining operation, the resulting material flow allows good control of the overhang. The coin operation preferably occurs after shearing. The coin may be pressed into the top of the spring as shown or pressed into the bottom surface. The foregoing concept relates to a "small distortion" in the local area of the spring tip. Alternatively, shrinking the overall length can alternatively accomplish the same effect as follows. Material flow and creation of an overhang may occur after the shearing step from residual stress in power spring 90 after it is die punched. For example, connecting ends 91*c*, 92*a* may be drawn toward end 91*b* as the part becomes slightly shorter from stress relief as the interior is cut to form the slots around center arm 91.

Figure 5:
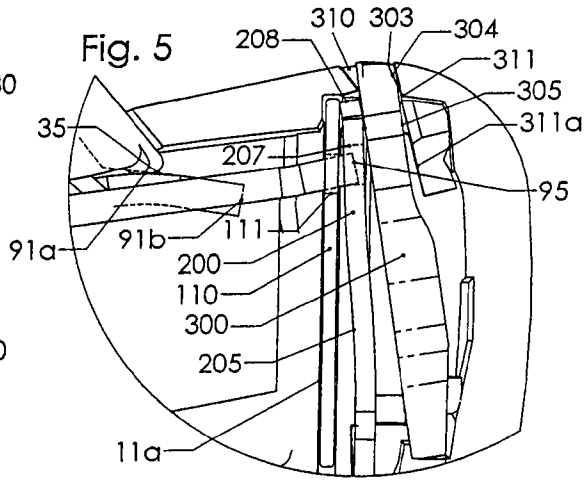
FIG. 5 is a detail view of an upper, front area of the stapler of FIG. 1.
Figure 10:
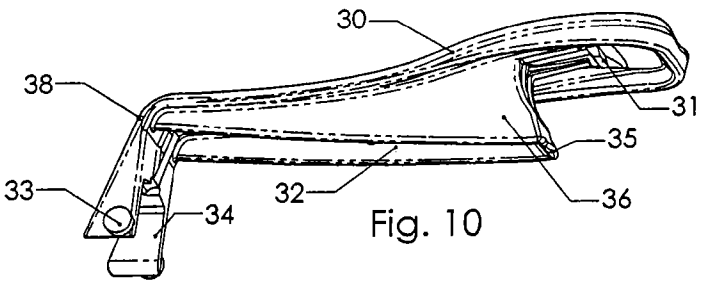
FIG. 10 is a side perspective view of a stapler handle.
Figure 30:
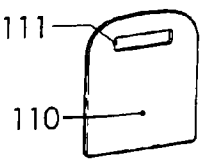
FIG. 30 is a perspective view of a striker.

FIG. 22 is the shape that power spring 90 assumes when the user presses on handle 30 to energize power spring 90. Specifically, handle 30 has a shark fin shaped rib structure 36 that presses against center arm 91 to bend and load power spring 90. Outer arms 90 are deflected into a slight U-shaped curve as well although not directly acted upon by handle 30. Outer arms 90 assume this shape because front tip 95 of power spring 90 is held motionless by latch 200 at the front (FIG. 5) and pivots at the rear 93. This loaded configuration of power spring 90 when the stapler is in its pre-release condition is shown in FIG. 18. More precisely, to attain the loaded power spring configuration of FIG. 22, spring tip 95 engages slots 111, 207 of striker 110 and latch 200, respectively (FIGS. 5, 17A, 30). Handle edge 35 of rib structure 36 presses near distal end 91*b* of center arm 91 (FIG. 17). Rib structure 36 moves within outer spring arms 92 with center arm 91 flexing upward (FIG. 18) into cavity 32 (FIG. 10) of rib structure 36 (FIG. 10). Rib structure 36 fits within ceiling edge 15 (FIG. 15).

In an alternative embodiment, center arm 91 may engage striker 110 while handle 30 presses outer arms 92 instead of center arm 91 of power spring 90 (not shown). In this embodiment, outer arms 92 would extend to separate distal ends, with center arm distal end 91*b* extending past the ends of outer arms 92. Rib structure 36 would press the distal ends of outer arms 92. The resulting operation of power spring 90 would be equivalent to that of the exemplary embodiment in which rib structure 36 engages center arm 91. Further optionally, more or fewer than three arms 91, 92 may be used in power spring 90.

An alternative way to link the ends of power spring 90 to maintain the preload is to include a separate component (not shown) that locks in the preload. Such a component could be a clip, pin, welded tab, or other structure attached to distal end 91*b*, outer arms 92, and/or connecting end 97 to selectively link or lock the respective ends together to create the desired preload. In this embodiment, distal end 91*b* and edge 94 may be spaced apart during the punching operation, rather than lanced, as a continuation of the slot surrounding center arm 91, where the separate component fills the gap. Similarly, center arm 91 and outer arms 92 may be discrete components joined at the spring rear end by welding, soldering, gluing, riveting or other secondary operations. Any of the foregoing spring designs can be used with a handle 30 that engages either center arm 91 or outer arms 92, with the center or outer arms linked to striker 110.

In another alternative embodiment, the power spring may be a single- or double-coiled, torsion wire spring (FIG. 23A) instead of the flat bar spring 90 shown in FIGS. 20-23. Two wire coils at the rear end include forward extending arms 92*d* and loop 91*d*. Loop 91*d* may link to striker 110 and arms 92*d* may link to handle 30 or vice versa. Loop 91*d* provides the equivalent function to center arm 91, and arms 92*d* function equivalently as outer arms 92 of flat power spring 90. The distal ends 91*d* and 92*d* of double torsion spring 92*f* are preferably co-planer in the plane of the page of FIG. 23A.

In still other alternative embodiments (not shown), flat power spring 90 with its two outer arms and center arm may be replaced by a single bar flat spring that is pivoted at the back and selectively linked at the front to striker 110. As handle 30 is pressed, the single bar spring is energized. The striker release functions with this single bar embodiment as described below in connection with the exemplary power spring 90. In another embodiment, flat power spring may be two cantilevered arms, with a freely cantilevered center arm and only one outer arm that is selectively linked to striker 110, wherein both arms are integrally joined at the back and pivot against the housing. In this two arm embodiment, the center arm is deflected by the handle being pressed by the user. Once the striker is released, the single outer arm drives the striker into the staple to be ejected. Optionally, the two arms may be reversed with the center arm linked to the striker and the single outer arm pressed by handle 30.

Figure 28:
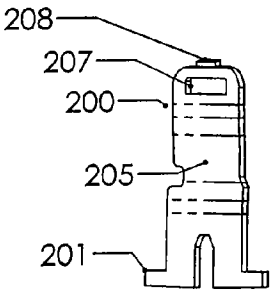
FIG. 28 is a perspective view of a latch.
Figure 27:
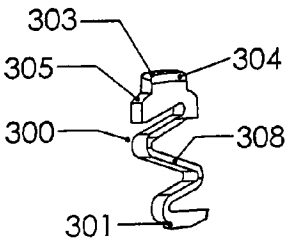
FIG. 27 is a perspective view of a latch holder.

FIGS. 27 and 28 show a latch holder 300 and latch 200, respectively, that work in conjunction to release striker 110 to fire the stapler. Such a release mechanism holds striker 110 and outer spring arms 92, with spring tip 95, in the upper rest position until a predetermined release point. The release mechanism may operate in a similar manner to that disclosed in co-pending U.S. patent application titled "High Start Spring Energized Stapler," filed on Jan. 20, 2006, Ser. No. 11/343,343, by Joel S. Marks, whose entire contents are hereby incorporated by reference.

In the detail view of FIG. 5, a rest condition of the release mechanism is shown. Specifically, latch holder 300 includes distal end 303, and a zigzag resilient portion 308 connects distal end 303 to lower mount 301 (FIGS. 4, 27). Lower mount 301 engages a recess, rib, strut, or other suitable anchoring feature of housing 10. Latch holder 300 is optionally pivotally attached at lower mount 301. Zigzag resilient portion 308 causes distal end 303 to be biased upward in FIG. 5. The zigzag path of portion 308 provides a longer resilient or spring section to allow more energy storage as compared to a straight section, thus giving an effect equivalent to the coil of a conventional compression spring. Upward movement of distal end 303 is limited by shoulders 305 or other structure of latch holder 300 pressing against housing 10. Distal end 303 of latch holder 300 is also visible in FIG. 31. It is preferably a small structure that is visible on the exterior of the housing. It may be made of the same color as the housing to avoid drawing attention since distal end 303 is not normally directly operated upon by the user. If handle 30 is of a design that partially surrounds or encloses the housing (not shown), then distal end 303 might be obscured and would not be visible to the user. As seen in FIG. 4, distal end 303 protrudes through an opening in housing 10, and when the user presses down on handle 30, triggering rib 31 underneath the handle engages and pushes on distal end 303 to begin a sequence of events that eventually releases striker 110 and fires the stapler.

As seen in the detail view of FIG. 5, spring tip 95 extends through slot 111 of striker 110 and at least partially into slot 207 of latch 200. Latch holder 300 in turn prevents latch 200 from moving forward. Latch 200 therefore selectively immobilizes striker 110 and limits downward motion of striker 110 as power spring tip 95 presses down within slot 207 as power spring 90 is loaded by the user pressing down on handle 90. Power spring tip 95 thus remains stationary until its release as handle 30 is pressed. Latch 200 is preferably made from hardened steel.

As handle 30 is pressed, the stapler assumes the pre-release configuration of FIGS. 17, 17A, and 18. In FIG. 17A, it is seen that the curved power spring tip 95 engages latch slot 207 at a non-perpendicular angle, thereby pressing downward and forward on latch 200. Latch 200 under this power spring pressure presses forward against latch holder 300. This is a pre-release position where handle 30 is preferably near to its closest possible position toward housing 10. Spring center arm 91 is deflected or bent downward while outer arms 92, along with connecting end 97 and tip 95, remain in the upper position. Outer arms 92 are bent upward in relation to center arm 91. Accordingly, power spring 90 assumes the approximate shape of FIG. 22.

In FIGS. 17 and 17A, as a result of the downward pressure applied by the user on handle 30, triggering rib 31 of handle 30 has moved latch holder 300 downward. However, distal end 303 is still engaging corner 311 of release opening 310, so latch holder 300 cannot move forward. Therefore, latch holder 300 continues to prevent latch 200 from being driven forward by the bias of angled spring tip 95, and spring tip 95 continues to be held in the up position.

As best seen in FIG. 21, spring tip may include an optional bend upward to enhance the angular engagement between spring tip 95 and slot 207. The shape of the bend may be selected to optimize the release action, providing just enough forward bias to reliably move latch 200 forward while not so much that other components such as latch holder 300 or housing 10 are distorted by excess biasing force from power spring 90. Even if the bend is not explicitly local or discrete, it is implicit in the inherent angle of the general front region of the center arm as in FIG. 17. If there is excessive forward bias, the handle force required to press distal end 303 is needlessly increased through the resulting sliding friction upon latch holder 300.

In FIGS. 19 and 19A, the striker released condition is shown. Triggering rib 31 of handle 30 has pushed distal end 303 of latch holder 300 below corner 311 of housing 10, allowing latch holder 300 to move forward under the forward bias of power spring 90 as transmitted through latch 200 which has also tilted forward. Shoulders 305 of latch holder 300 optionally engage edge 311*a* (FIGS. 15, 17A) to provide an additional release edge-bearing surface. Latch 200, urged forward under power spring bias but previously held in place by latch holder 300, is now free to move forward. Once the top end of latch 200 tilts forward, slot 207 of latch 200 no longer confines spring tip 95, allowing spring tip 95 to freely accelerate downward under spring bias to fire the stapler. Since spring tip 95 is captured within slot 111 of striker 110, the downward motion of spring tip 95 accelerates striker 110 in the same direction.

After its release, striker 110 rapidly moves downward to eject a staple (not shown) disposed on staple track 80 by impact blow, and handle 30 remains in the lowered position. After striker release, power spring 90 resumes its rest shape of FIG. 21, but in the lower position of FIG. 19 prior to reset, rather than the upper rest position of FIG. 1. That is, power spring 90 in accelerating the released striker 110 downward has rotated at its rear 93 about pivot 13 of housing 10 so that power spring 90 is angled downward at its front end, in contrast to power spring 90 after being reset to its initial position of FIG. 1. After release and ejecting a staple, striker 110 is in its lowest position in front of track 80 (FIG. 19).

Figure 24:
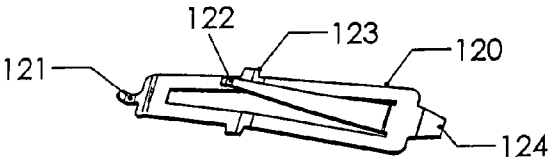
FIG. 24 is a perspective view of a flat reset spring.

Downward pressure on handle 30 is then removed by the user so that handle 30 is biased upward in a reset action to the handle rest position of FIG. 1. Striker 110 and power spring 90 move upward with handle 30 in the reset action under the bias of reset spring 120 (FIG. 24).

Latch holder 300 preferably includes an angled or chamfered portion 304 (FIGS. 17A, 27). As triggering rib 31 presses on latch holder 300, this angled portion 304 allows latch holder 300 to move forward slightly. As discussed earlier, latch 200 is pressed forward against latch holder 300 under bias from the bent spring tip 95. As seen in FIG. 17A, the geometry of angled portion 304 pressing slightly upward on corner 311 of housing 10 creates a slight downward tendency on latch holder 300, just less than the friction holding the system in place. This reduces the force required from triggering rib 31 to press latch holder 300 downward to fire the stapler. Latch holder 300 is preferably made from a low friction material such as Delrin, acetal, nylon, Teflon, greased metal, or other low friction material. These types of low friction materials help minimize wear between latch holder 300 and housing 10 at corner 311 and improves the life of the stapler. A low friction interface also helps ensure the release action is reproducible and reliable.

Latch 200 preferably includes at its top end a tab or section 208 angled rearward (FIGS. 5, 17A, 28). This rearward angled tab 208 reduces the friction at the interface between latch 200 and latch holder 300 by presenting a smooth face of the former to slide against the latter. On the other hand, if latch holder 300 moves against a sharp metal edge latch 200 missing the angled tab, the force to press latch holder 300 down is increased. To ensure latch 200 is assembled in the correct direction during production, it preferably includes an asymmetric feature such as the side notch seen in FIG. 28. This side notch fits around rib 13*a* or similar structure in the left half of housing 10, the side shown in FIG. 15. Latch 200 may be produced without angled tab 208 if the rear, upper edge of the latch is rounded or deburred to present a smooth edge to latch holder 300.

As handle 30 is allowed to rise toward the start position, reset spring 120 (FIG. 24) biases power spring 90 so that front connecting end 97 pivots upward. Specifically, reset spring 120 has a center arm with an out-of-plane bend. As best seen in FIG. 1, distal end 122 of the center arm of reset spring 120 presses an area proximate the rear of power spring 90, biasing power spring 90 to rotate about pivot 13 and lifting the front connecting end 97 thereof The total motion of distal end 122 of reset spring 120 is therefore minimal in contrast with a reset spring pressing near the front of power spring 90, where motion or travel is necessarily greater. With a small motion of reset spring 120, the reset force can be relatively constant since the start and end shapes of the reset spring are not very different.

Reset spring 120 is preferably a flat bar spring arranged generally in parallel and spaced apart from flat power spring 90 inside housing 10. Because of lower force requirements, reset spring 120 is physically smaller than power spring 90. The central arm of reset spring 120 including distal end 122 is optionally tapered in width—large width at the proximal base and decreasing width toward the distal end 122—for efficient energy storage by providing a more constant bending stress in the spring material from end to end. This principle may be applied to power spring 90 as seen in FIG. 23, where each arm is tapered, narrowing from a cantilevered based toward the front or moving end. Power spring 90 preferably also includes an overall tapered shape to allow housing 10 to be relatively narrow at the front end, as partially seen in FIG. 3. To be sure, the shape of power spring 90 and reset spring 120 as seen in the plan views of FIGS. 23 and 24 are preferably tapered with a large width at the base leading to a narrow width distal end. In alternative embodiments, other shapes are contemplated including an oval, a half oval, a rectangle, a diamond, and the like.

The exemplary embodiment power spring 90 and reset spring 120 have preferably a constant thickness profile. Alternatively, the taper of the power and resets springs may be in the form of changing thicknesses from a profile view with a thick cross-section at the base and a thin cross-section at the distal tip.

Reset spring 120 may include other features described in the following. As seen in FIGS. 1 and 17, reset spring 120 is pivotably mounted to housing 10 at outward extending tabs 123. Tabs 123 are located at about a midpoint but slightly toward rear end 121 and provide the pivot axis for the spring. As such, pressing upward on the curved rear end 121 (FIG. 24) causes front tip 124 to move downward (FIG. 1). When staple track 80 is in its operating position (as in all views other than FIG. 7), base rib 27 projecting upward near the back end of base 20 (FIG. 9) presses upward on rear end 121 of reset spring 120 (FIGS. 16, 19). Comparing FIGS. 7 and 19, reset spring tip 124 is slightly raised when track 80 is pulled out to the open position (FIG. 7), and tip 124 is lowered when track 80 is moved to the operating position (FIG. 19).

The action at reset spring tip 124 may be linked to a safety mechanism in an alternative embodiment (not shown). For example, in the track open position of FIG. 7, raised reset spring tip 124 may engage an element that prevents latch 200 from moving forward. Or tip 124 may engage an element that prevents striker 110 or power spring 90 from moving downward. The stapler is then prevented from ejecting a staple when track 80 is open to allow a user to safely reload staple chamber 14. When track 80 is slid back into housing 10 to the closed position, reset spring tip 124 lowers and disengages from the latch, striker, and/or power spring to enable ejection of staples.

Optionally, reset spring 120 is fixed with respect to tip 124. When track 80 is open as in FIG. 7, it is unlikely that a staple will accidentally be ejected since handle 30 is not readily pressed by squeezing between base 20 and the handle. Furthermore, the energy stored in power spring 90 is relatively low in the preferred embodiment of the present invention intended for light duty use, wherein the stapler has a normal capacity of about 10 pages.

Rear end 121 of reset spring 120 biases base rib 27 downward. As a result, the bias causes base 20 to pivot away from housing 10 about boss 23 in hinge 84 of track 80 (FIG. 16). Base 20 maintains the open position of FIG. 1. As the stapler is squeezed, base 20 closes against the light bias of rear end 121 of reset spring 120 to the position of FIG. 17. In an alternative embodiment, recess 26 (FIG. 9) in base 20 may receive a small spring (not shown). Such a small spring could be a coiled compression spring to bias base 20 away from housing 10. The compression spring can be used in place of or in addition to the bias from rear end 121 of reset spring 120. Furthermore, reset spring 120 may omit tip 124 and/or extended rear end 121, if it is desired that the reset spring only provide a reset bias to the mechanism rather than the additional functions of biasing the base and a safety linkage described above.

Figure 7:
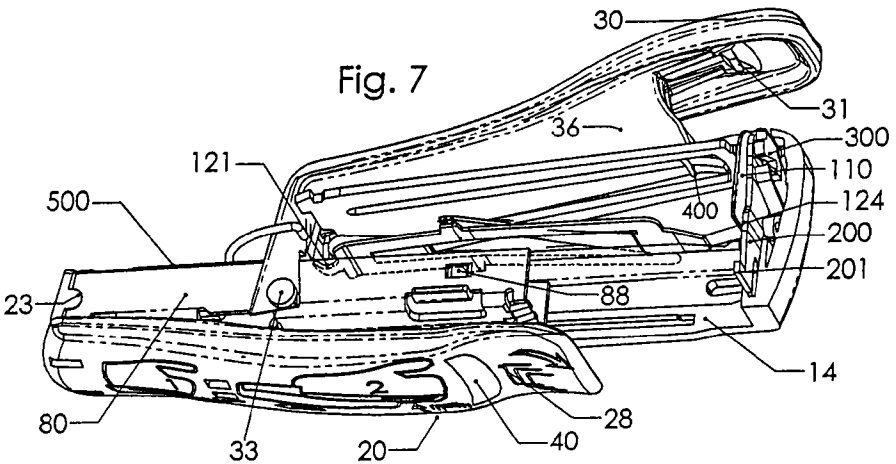
FIG. 7 is a bottom, side perspective view of the stapler, with the base sub-assembly moved to a rear, open position.
Figure 8:
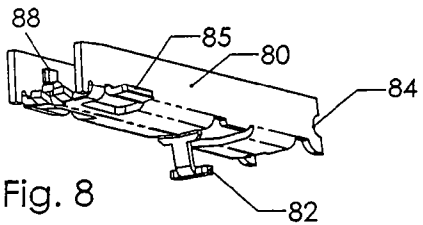
FIG. 8 is a front perspective view of a stapler track.

As seen in FIGS. 7, 8, track 80 includes tabs 85 to slidably engage channels in housing 10. In the exemplary embodiment, tabs 85 are horizontally slidable within chamber 14 for the base sub-assembly in its sliding engagement with housing 10. Rib 18 of housing 10, and adjacent structure to the rear, provide further guidance for the base sub-assembly, forming a bottom partial enclosure for chamber 14. The base sub-assembly is thus held in a sliding, telescoping relationship to housing 10 through the mounting of track 80 in housing 10.

FIG. 7 shows the track/base sub-assembly of FIG. 16 slid to a rear position to expose loading chamber 14. To load the staples (not shown), base 20 is pressed and urged to slide rearward as shown in optional graphic 20*a*, step 1, in FIG. 3. The stapler is normally held with chamber 14 facing upward. Staples are dropped into the chamber as shown in optional graphic pictogram 20*a* on the bottom of base 20 where the stapler is shown upright (FIG. 3). After receiving the staples, track 80 is slid forward to the operational position depicted in FIGS. 1, 4, or 6 for example. In the operational forward position, the forward faces of sail-like tabs 11 (FIG. 15) extending underneath housing 10 slide into engagement with the rearward facing walls of recesses 21 in base 20 to hold the base in the forward position (FIG. 31).

Figure 12:
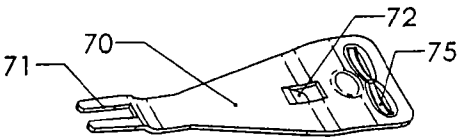
FIG. 12 is a top perspective view of a cover plate.

Each side of base 20 has semicircular pivot boss 23 at rear wall 24 (FIG. 16) that engages and pivots against a complementarily shaped hinge 84 at the back end of track 80 (FIG. 8). A T-shaped catch 82 extends upside down from underneath track 80 (FIG. 8). The T-shaped catch 82 extends through the slot formed by parallel extensions 71 in cover plate 70 (FIG. 12) to below cover plate 70. By hooking the extensions 71, the cross bar in the T-shaped catch 82 thus limits the downward rotation of base 20 away from housing 10. Other shapes for the catch 82 are of course contemplated, including an inverted "L" or hook shape. Accordingly, base 20 cannot pivot any farther than the lowest most position relative to track 80 shown in FIG. 1.

To open track 80, base 20 is pushed as shown in step 1 of graphic 20*a* in FIG. 3 and as described above. This action causes base 20 to be pulled downward against T-shaped catch 82, whereby cover plate 70 flexes slightly at extensions 71 that engage the cross bar of the T-shaped catch 82. Other elements of the base sub-assembly may also flex. The slight flexing of these components provides sufficient clearance so that base 20 at recesses 21 clears sail-like tabs 11; once base 20 at recesses 21 clears the obstructing tabs 11, the base/track sub-assembly can freely slide rearward as in FIG. 7. Once track 80 is slid rearward, staple chamber 14 inside housing 10 is exposed.

To close base 20, it is pushed forward to return to its normal position under housing 10. Recesses 21 include optional raised ramps (FIGS. 1, 9) in front to help guide and secure sail-like tabs 11 during closing. Comparing FIGS. 1 and 17, it is seen that T-shaped catch 82 moves downward inside recess 25 of base 20 as the base rotates toward housing 10 when the user squeezes the stapler. Once the user releases the squeezing pressure, T-shaped catch 82 moves back upward inside recess 25. Cover plate 70 of the base sub-assembly includes anvil 75 for forming the legs of the staples; the anvil may be integrated as part of cover plate 70 or may be a separate component.

Preferably, the cover plate 70 and anvil 75 are made from metal. Optionally, anvil 75 features a low friction electroless nickel plating to facilitate bending of the staple legs against the anvil surface. The entire cover plate 70 may also be electroless nickel plated. Electroless nickel plating with low phosphorus contents between about 3%-7% have high wear resistance, low friction and high surface hardness (e.g., up to 60 Rockwell C). A phosphorus content of about 9%-12% exhibits corrosion and abrasion resistance, and lower surface hardness (about 45-50 Rockwell C). Finally, a phosphorus content of about 10%-13% produces a coating that is very ductile and corrosion resistant. The higher phosphorus content plating meets the demands for corrosion resistance against chlorides and simultaneous mechanical stresses.

Thus, electroless nickel when alloyed with or containing phosphorus, exhibits increased wear resistance and chemical resistance. In the application for a stapler anvil, low friction and wear resistance are of interest. Percent phosphorus may range from about 2% to about 13%, inclusive of the upper and lower limits and all amounts therebetween, with lower ranges tending to manifest better wear resistance and lubricity. In the present stapler anvil application, the phosphorus content is more preferably about 3%-8%. Other hard low friction surface treatments may be applied to the anvil to provide a low friction, low wear interface between steel of the anvil and points of a staple.

Electroless nickel plating is preferably applied to the components in a thickness of about 0.0001 inch to 0.0010 inch, inclusive of the upper and lower limits and all amounts therebetween, although other thicknesses outside this preferred range are possible. The specified range of thicknesses provide the desired improved properties without increasing the part dimension excessively or causing processing difficulties. More preferably, the electroless nickel plating on the anvil has a plated thickness of about 0.0003-0.0006 inch, inclusive of the upper and lower limits and all amounts therebetween. Once the anvil is plated, the electroless nickel provides an interface between the anvil and the staple points being formed. Less force is required to form a staple behind the sheets of papers to be bound due to lower friction sliding of the staple legs within anvil 75 as they are bent.

Figure 11:
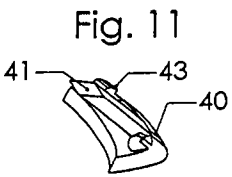
FIG. 11 is a side perspective view of a cover plate holder.
Figure 9:
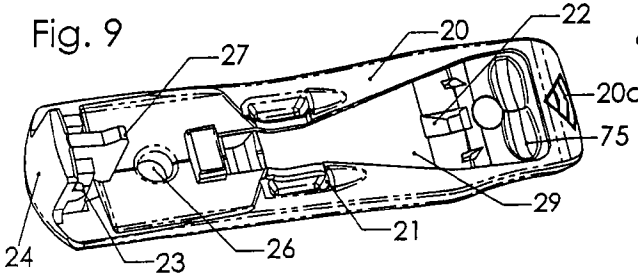
FIG. 9 is a top perspective view of a stapler base.

For assembly of the base sub-assembly of FIG. 16, track 80 is positioned with hinge 84 partially circumscribing boss 23. Base 20 is rotated to move T-shaped catch 82 into recess 25 (FIG. 17). Hinge 84 is held by boss 23 with T-shaped catch 82 being confined by the front limit of recess 25 of the base. Cover plate 70 is slid rearward so that extensions 71 capture T-shaped catch 82. Extension 25*a* projecting forward from base 20 forms a ceiling of a forward facing recess to hold extensions 71 in position underneath extension 25*a* (FIGS. 3, 17). The forward part of cover plate 70 is then moved adjacent to base 20 within optional recess 29 (FIG. 9). Recess 29 has a shape preferably coinciding with the shape of cover plate 70 for a matching fit. Cover plate 70 includes downward extending tab 72 (FIG. 12) that fits in opening 22 in base 20 (FIG. 9) when the two parts are assembled together. Finally, to lock cover plate 70 to base 20, cover holder 40 (FIG. 11) is installed into base 20. Specifically, tab 41 of cover holder 40 fits along downward extending tab 72 in cover plate 70 (FIGS. 1, 11). Tab 41 acts as an obstruction within opening 22 in base 22 whereby downward extending tab 72 is prevented from moving upward. Accordingly, cover plate 70 is prevented from disassembling from base 20. Cover holder 40 may include optional snaps 43 (FIG. 11) or equivalent structures to retain the cover holder to base 20.

In various alternative embodiments (not shown), a metal cover plate may be molded directly into a polymer base obviating the need for some components described above. Screws, snaps, rivets, and like fasteners or cement may be used to secure the cover plate to the base. The entire base and cover plate may also be made from a molded polymer with a metal anvil joined thereto or molded therein, or the majority of the base and anvil may be made from metal to omit the cover plate.

Latch 200 is preferably mounted pivotably in housing 10. Accordingly, latch 200 has optional pivot tabs 201 (FIGS. 2, 28) that form the pivot and fit into respective recesses 17 in housing 10 (dashed lines in FIG. 15). Recess 17 includes engagement with the upper edge of pivot tabs 201, so latch 200 is held from shifting upward. This feature is helpful during reset action as spring tip 95 slides and arcs upward along latch 200 as power spring 90 pivots about spring rear 93 in pivot 13.

After striker release, spring tip 95 contacts latch 200 in the position shown in FIG. 19. Latch 200 is thus held in its forward position. Consequently, latch holder 300 is also held in its forward position (FIG. 19A). Spring tip 95 moves in an arc about pivot 13 as discussed earlier. During reset, latch 200 should remain in the forward-most position so that it does yet resume the latch pre-release position in FIG. 17A, aligned with release opening 310. The forward-most latch position holds latch holder 300 out of the way. If latch 200 is allowed to move to the rear position, latch 200 becomes locked in the rear, rest position by latch holder 300 entering release opening 310. Latch 200 would then block or obstruct the desired movement of spring tip 95, preventing it from moving up and into slot 207 of latch 200 to complete the reset action.

To ensure that latch 200 remains forward during reset, latch pivot tabs 201 and recesses 17 receiving those pivot tabs are preferably located as low as possible in housing 10, nearly adjacent to cover plate 70 in the pressed position of FIG. 17, near the bottom of chamber 14. The distance or torque arm as measured between pivot tabs 201 and spring tip 95 in the after-release position of FIG. 19 is maximized to allow spring tip 95 to apply useful holding torque on latch 200. This ensures that latch 200 remains forward during reset.

Optionally, pivot tabs 201 maybe located at a higher position and a further component, (not shown) may link striker 110 and/or spring tip 95 to hold latch 200 in the forward-most position during reset. Such a link may be a forward protrusion (not shown) from striker 110 near the top of the striker, where the forward protrusion makes contact with latch 200 instead of or in addition to spring tip 95.

It is desirable that spring tip 95 holds latch 200 in a steady position during reset. As discussed above, latch 200 should preferably not move rearward during reset. It also should preferably not be forced forward by spring tip 95. Doing so would require forcing latch holder distal end 303 forward against the downward angled ceiling forward of corner 311 in housing 10. This forcing action would create extra friction between spring tip 95 and latch 200, requiring inefficient extra force from reset spring 120. As best seen in part in FIG. 5, latch 200 includes arcuate portion 205. This arcuate portion 205 is essentially an arc with its center located near pivot 13 of power spring 90 at the rear of housing 10. As power spring 90 pivots, spring tip 95 follows its natural arc upwards; this arc corresponds to arcuate portion 205 which gives extra clearance to the spring tip reset motion. As a result, latch 200 remains stationary as spring tip 95 pivots during reset. In contrast, a latch with a straight profile would intercept or impede the arcuate motion of spring tip 95, leading to the undesirable forced action described above.

The angled ceiling of housing 10 discussed above in front of corner 311 is optionally present to bias latch holder distal end 303 rearward toward reset opening 310. In the final reset action, spring tip 95 becomes aligned with latch opening 207. Latch holder 300 and latch 200 move rearward under this bias so that latch opening 207 resumes the rest position of FIG. 5.

It is preferred that striker 110 be electroless nickel plated according to the procedures, thickness, and compositions described above for the anvil. Empirical testing has shown such plating substantially reduces friction between the striker and surrounding parts. In one instance, it is desirable to minimize the friction between the forward-most staple in track 80 (not shown) that is urged by staple pusher 100 into the just-released striker 110 during the striker's upward reset motion. The force required of reset spring 120 is determined largely by this friction. The forward-most staple is biased against striker 110 by a pusher spring (not shown) operating on pusher 100. With a full rack of staples, about 50 staples in the case of a one-inch long rack, this bias is at a peak since the pusher spring is deflected to a greatest extent. With electroless nickel plating on the striker, the striker slides easily against the forward-most staple so a light force or low spring constant reset spring can be used. Further, a light force reset spring does not substantially add to the effort to press handle 30, which is already burdened with energizing power spring 90. With a light force reset spring, the perceived effort of the user pressing on handle 30 is reduced. For example, a reset bias on handle 30 of less than about 5 ounces at pressing area 37 is practical with a striker having the electroless nickel striker plating, or other efficient coatings. Finally, a light force reset spring can be smaller in size which suits its use in a miniature stapler.

To enhance the motion of handle 30 relative to power spring 90, handle 30 preferably extends slightly past the front of housing 10 in the pressed handle, striker released position of FIG. 19. In this position, the front end of handle 30 arcs rearward toward the normal rest position. This is possible because handle 30 is preferably hinged at a low rear corner of housing 10 at post 33 and preferably has an "L" shape profile (FIG. 17). The stapler therefore has a minimal length in the rest position, with the handle substantially flush with the front end of the housing as shown in FIG. 1.

To further enhance the leverage of handle 30 with respect to power spring 90, the same arcing motion described above allows for a sliding or translating cam action between the power spring and the handle. In FIGS. 5 and 10, handle edge 35 at the bottom corner of shark fin shaped rib structure 36 presses at bend 91*a* in center arm 91 of power spring 90. In FIG. 17, handle edge 35 has slid forward along the angled section of center arm 91 in front of local bend 91*a*. Bend 91*a* is "local" because it preferably appears from the distal end 91*b* by a distance of up to about 25% of the entire length of the cantilevered center arm 91 with this location maximizing its effectiveness. The downward angle in front of local bend 91*a* is selected to allow the handle at edge 35 to move downward toward the bottom of the stapler faster than front end 91*b* of center arm 91. The increased motion at edge 35 relative to the power spring deflection translates to increased motion of handle 30 and leverage on power spring 90, since leverage is a function of relative motion being greater with increased motion.

If still additional leverage is desired between handle 30 and power spring 90, an intermediate lever between the power spring and handle may be used in an alternative embodiment. Such leveraging mechanisms are disclosed in co-pending U.S. patent application titled "High Start Spring Energized Stapler," filed on Jan. 20, 2006, Ser. No. 11/343,343, by Joel S. Marks, whose entire contents are hereby incorporated by reference. Accordingly, a separately movable cage is employed to maintain a preload on the power spring.

Housing 10 substantially defines a height and a length of the body of the stapler. In the exemplary embodiment, the body of the miniature stapler defined by the housing is about 2.9 inches long and about 1 inch high. This is a length-to-height aspect ratio for the housing of about 3:1. The aspect ratio results in a housing proportioned for a comfortable and ergonomic fit in a user's hand.

Handle 30 is pivoted at handle hinge posts 33, with the posts fitted in recesses 16 of housing 10 (FIGS. 10, 15), or equivalent pivoting engagement. This pivoting engagement 16, 33 is distant from handle pressing area 37. Handle 30, having preferably an "L" shape, is hinged diagonally across the height and length of the body from pressing area 37 (FIG. 10). Specifically, hinge post 33 is located at a lower, rear end of housing 10, while handle pressing area 37 is located at a front top region of the stapler. Handle 30 thus provides a very long lever arm, with minimum practical angular change as pressing area 37 moves toward housing 10. Further, the crotch of the "L" shaped handle gives room to accommodate the internal components of the stapler yet maintaining efficient packaging and limiting overall size.

In the illustrated embodiment, pressing area 37 moves about ½ inch toward housing 10 from the initial position of FIG. 1 to the lowest position of FIG. 19, with a preferred range of about 0.4 to 0.6 inch inclusive; and striker 110 moves about 0.4 inch from its upper rest position to its lowest position. In accordance with the above description, a miniature spring powered stapler may provide useful performance relative to size with a housing or body shape that includes a housing or body length-to-height aspect ratio ranging from about 2:1 to 4:1 inclusive, and more preferably about 2.5:1 and 3.5:1 inclusive. An imaginary line may extend from boss receiving recess 16 in housing 10 to the upper front of housing 10, near reset opening 310, to make an angle relative to the extended length of track 80. This angle is preferably about 14° to 25° inclusive of the outer limits and all values therebetween, and more preferably about 19° to 23° inclusive. This angle represents a practical shape for a spring-powered stapler associated with the minimal length provided by the features of the present invention.

The stapler includes a squeezing distance defined between the underside of base 20, for example, at concave contour 28 to handle pressing area 37. This squeezing distance in the exemplary embodiment is preferably a maximum of about two inches in the rest position of FIG. 1 and a minimum of about 1.25 inch in the pressed position of FIG. 17. The maximum is preferably between about 2.5 inches to 1.8 inch inclusive of all values between the limits and including the limits, and the minimum is preferably between about 1.1 to 1.4 inch inclusive of all values between the limits and including the limits. In various alternative embodiments, the maximum squeezing distance is between about 1.8 to 2.2 inches inclusive, and the minimum squeezing distance is between about 1.25 to 1.35 inch inclusive. Accordingly, the forgoing dimensions and proportions result in a miniature stapler sized to fit ergonomically within the hand of a typical young adult user to comfortably and efficiently apply pressure on pressing area 37 of handle 30 and on concave contour 28 in base 20.

The compact elements of the stapler include substantially planar power spring 90 with co-extensive arms as described earlier, a thin, elongated base 20, and a compact release and reset mechanism. The track-opening mechanism is contained entirely within confines of the stapler body, with no bulky protruding parts. As a result of the compact and sleek design of the exemplary embodiment stapler, the small dimensions described above are achievable in a spring-powered stapler.

Alternatively, a taller stapler is contemplated. In such an embodiment, striker 110 moves more than 0.4 inch and pressing area 37 more than 0.5 inch. For example, the striker may move 0.7 inch, and handle pressing area 37 moves about 0.9 inch. In a preferred embodiment, the handle has an upper rest position and a lower pressed position, and the pressing area of the handle moves between about 0.4 to 0.7 inch inclusive, and more preferably, the pressing area moves between about 0.4 to 0.5 inch inclusive, as the handle moves from the upper rest position to the lower pressed position.

Figure 6A:
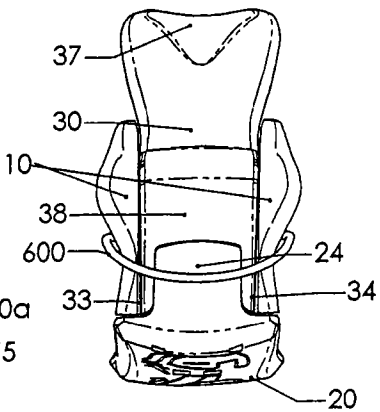
FIG. 6A is a rear elevational view of the stapler of FIG. 1.

Hinge posts 33 are part of thin extensions 34 of handle 30 (FIGS. 6A, 10). Using such narrow extensions 34 makes possible a minimum width for the stapler in the rear area. To ensure that posts 33 do not inadvertently pull out from recesses 16 during use as a result of flexibility of extensions 34, rear base structure 24 fills the opening created by extensions 34. In the case of the open position in FIG. 7, track 80 fills in this space. Posts 33 are thereby captured in recesses 16. Further, pressing area 37 is not too far forward of handle edge 35, so there is minimal leverage to create upward shear forces acting on posts 33 as handle 30 is pressed.

Figure 6:
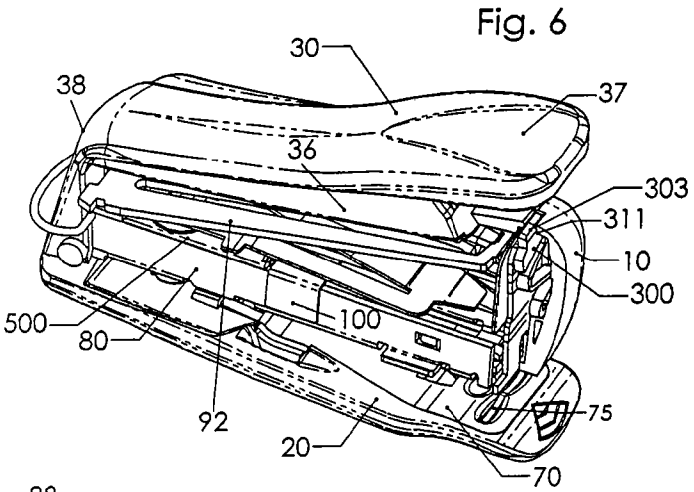
FIG. 6 is a top, side perspective view of the stapler of FIG. 1.

Handle 30 preferably has a top portion and a partial rear enclosure 38 for the body of the stapler as best seen in FIGS. 6 and 6A. Rear enclosure 38 (FIGS. 6A, 10) is substantially coincident with a rear edge of housing 10 (FIGS. 1, 31). Described a different way, rear enclosure 38 does not extend past a rear extent of housing 10, wherein housing 10 surrounds sides of rear enclosure 38 of handle 30. Housing 10 is assembled from two halves to each side of handle 30. In this manner, handle 30 covers or encloses open top and rear facing parts of housing 10, without adding to the length of the stapler.

The assembled right and left housing halves (FIG. 15), in the absence of handle 30 and base 20, may be open to the top and rear. Reduced material usage is possible, as no housing material is needed along the top or rear of the stapler. Also the stapler can be more compact than if the handle extended past the rear end of the housing. Similarly, rear structure or wall 24 of base 20 forms a lower rear enclosure for the stapler (FIG. 6A). In FIG. 17 it is seen that an interior of handle rear enclosure 38 has moved from the position of FIG. 1, spaced away from the power spring, to be immediately adjacent to the rear of power spring 90; no housing material or other element is situated between these components. This preferred arrangement allows the longest power spring to be used in the smallest package, while allowing the handle to still have a close fit for space savings in a miniature stapler.

Track 80 fits closely between handle extensions 34 so that if staples are accidentally placed upon the top, rear of track 80 in the open track position of FIG. 7, the staples fall harmlessly off the track as the base sub-assembly is pushed to the closed position. This indicates to the new user that the staples have been loaded in the stapler improperly. If the staples can pass inward, they cannot function and the mechanism may be impaired. As discussed above, the staples are installed into the opening of chamber 14, at the opening in the bottom front (FIG. 7).

In FIGS. 14 and 16, staple pusher 100 is shown. In the assembly of FIG. 16 the pusher is in a rear position as it would be when behind a rack of staples, not shown. A spring (not shown) biases the pusher toward the front of track 80. Pusher 100 includes a main front portion that surrounds track 80. Rear portion 101 is narrower and fits within track 80. It is desirable to have pusher 100 as long as practical to provide room for a long pusher spring (not shown) attached to hook 105. By using narrow rear portion 101 within track 80 a relatively long pusher fits between extensions 34 of handle 30 (FIG. 7). Pusher 100 includes notch 102 (FIG. 14). This notch engages inward extending tab 88 (FIG. 8) of track 80 when the pusher is in the forward position. In the base sub-assembly of FIG. 16, pusher 100 is normally in a forward position (as compared to the rear position shown) aligned with the front of track 80 as a result of the bias of the pusher spring (not shown). Pusher 100 is held to track 80 during assembly by tab 88 in notch 102.

Track guard 500 (FIGS. 7, 14A, 16) fits on top of the rear of track 80. When the base sub-assembly is pulled to the open position of FIG. 7, track guard 500 provides a clean closed appearance to track 80. Further, track guard 500 provides a flat surface upon which graphical information can easily be placed. A user may be inclined to attempt loading staples atop track 80 in this rear position. If a user attempts to place staples on top of the rear of track 80, the staples will be wiped off as discussed above. If the user remains unsure how to load the staples, the surface of track guard 500 will be a likely area of focus. The graphics may be engraved into the plastic material of track guard 500. For example, graphic icons or information 501 may suggest not placing staples on top of the track. This information may supplement the graphics under base 20 (FIG. 3). Track guard 500 preferably has a convex top, being taller along the center and lower along the edges as seen in FIG. 14. This convex shape corresponds to the arcuate shape atop base rear structure 24 as seen in FIG. 6A. The convex shape further indicates to the user the incompatibility of loading staples at that location.

In FIG. 6A, an optional D-ring 600 is shown attached to the stapler. D-ring 600 includes short segments 601 (FIG. 2) to provide a snap fit into holes (not shown) in housing 10. Other shapes may be used for the ring to provide the equivalent function. The D-ring may be used to hang the stapler for storage, transport, or even as a key chain. It is seen that the D-ring is preferably located behind rear base structure 24 in FIG. 6A, and the other views except FIG. 7. In FIG. 7, D-ring 600 is rotated to be above track 80, specifically on top of track guard 500. The angle of rear base structure 24 causes the D-ring to slide to this higher position as base 20 is moved rearward to load the staples. The visual obstruction created by D-ring 600 on top of track 80 further suggests to the new user to load staples elsewhere.

Figure 29:
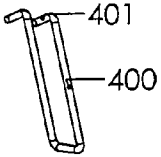
FIG. 29 is a perspective view of a retaining wire.

Optional pull-up wire 400 (FIGS. 7, 17 and 29) wraps under center arm 91 of power spring 90. Ends 401 snap into recesses within handle 30 (FIG. 17) to retain wire 400 to the handle. The wire provides a tensile linkage between the power spring and the handle. In normal use, this linkage is not required since reset spring 120 biases the assembly of power spring 90, striker 110, and handle 30 upward to the rest position. However, if the striker hangs up on the staples on track 80, or other unexpected interference occurs in the system, handle 30 can be forcibly raised to move striker 110 up to its rest position by pulling power spring 90 through pull-up wire 400. In this manner the force of reset spring 120 need not be so strong to overcome such occasional hang-ups.

From the foregoing detailed description, it should be evident that there are a number of changes, adaptations, and modifications of the present invention that come within the province of those skilled in the art. For example, although the preferred embodiment is directed to a miniature spring-actuated stapler, the present invention can also be applied to a standard size desktop stapler or to an industrial staple gun. Thus, it is intended that all such variations not departing from the spirit of the invention be considered as within the scope thereof except as limited solely by the following claims.

What is claimed is:

1. A stapler, comprising:

a housing;

a handle disposed toward a top of the housing, wherein the handle is pivotable between an initial position away from the housing and a lowest position toward the housing;

a base sub-assembly at a bottom of the housing including the base, a track pivotally attached to the base, and a cover plate fixed to the base, the track includes an extended length along a bottom of the housing, the base includes a first position pivoted to be adjacent to the track and a second position pivoted away from the track, the track pivotably attached to the base at a rear of the track;

wherein the base sub-assembly is slidably attached to the housing including a first position under the housing and a second position extending from the housing;

wherein the cover plate engages a tab of the track to limit motion of the base away from the track; and wherein a staple loading chamber inside the housing is exposed at a bottom of the stapler in the sub-assembly second position.

2. The stapler of claim 1, wherein a rear tab of the cover plate extends under a rib of the base to fix a rear of the cover plate to the base.

3. The stapler of claim 1, wherein a front tab of the cover plate extends under a rib of the base to fix a front of the cover plate to the base.

4. The stapler of claim 3, wherein the front tab extends into a recess of the base, and a cover holder extends into the recess to fix the front of the cover plate to the base.

5. The stapler of claim 1, wherein the cover plate includes a staple forming anvil.

6. A stapler, comprising:

a housing, a handle disposed toward a top of the housing, wherein the handle is pivotable between an initial position away from the housing and a lowest position toward the housing;

a base/track sub-assembly at a bottom of the housing including a base, a track pivotally attached to the base, and a cover plate including an anvil attached to the base, the track includes an extended length along a bottom of the housing, the base including a first base position pivoted to be adjacent to the track and a second base position pivoted away from the track, the track pivotably attached to the base at a rear of the track;

wherein the base/track sub-assembly is slidably attached to the housing including a first position under the housing and a second position extending rearward from the housing;

wherein the base engages a catch of the track to limit motion of the base away from the track, and in the second base/track sub-assembly position the catch maintains the anvil to be adjacent below a front of the track;

a striker slidably fitted at a front of the housing, the striker movable between a position above the track and a position in front of the track; and wherein a staple loading chamber inside the housing is exposed at a bottom of the stapler in the base/track sub-assembly second position.

7. The stapler of claim 6, wherein the base/track sub-assembly is flexible, and wherein a rib of the housing engages the base to selectively hold the base/track sub-assembly in the first sub-assembly position under the housing, and when the base is forced away from the housing against a limit of the catch of the track, the base/track sub-assembly flexes and the base moves clear of the rib of the housing.

8. The stapler of claim 7, wherein the base/track sub-assembly freely slides rearward in the base/track sub-assembly flexed condition.

9. A stapler, comprising:

a housing, a handle disposed toward a top of the housing, wherein the handle is pivotable between an initial position away from the housing and a lowest position toward the housing;

a base/track sub-assembly at a bottom of the housing including the base, a track pivotally attached to the base, and a cover plate including an anvil disposed in the base, the track including an extended length along a bottom of the housing, the base including a first base position pivoted to be adjacent to the track and a second base position pivoted away from the track, the track pivotably attached to the base at a rear of the track and the second base position including the anvil being adjacent and below a front of the track;

wherein the base/track sub-assembly is slidably attached to the housing including a first position under the housing and a second position extending rearward from the housing;

a striker slidably fitted at a front of the housing, the striker movable between a position above the track and a position in front of the track; and wherein the track is co-extensive within an elongated staple loading chamber of the housing, the track of the base/track sub-assembly moving within the chamber substantially exclusively by sliding on the housing between the first position of the base/track sub-assembly and the second position of the base/track sub-assembly;

wherein the staple loading chamber is exposed in front of the base at a bottom of the stapler in the sub-assembly second position; and wherein the base/track sub-assembly second position includes the base being in the second base position.

10. The stapler of claim 9, wherein a rib of the housing engages the base to selectively hold the base/track sub-assembly in the first position under the housing.

11. The stapler of claim 10, wherein the base/track sub-assembly is flexible, and when the base is forced away from the housing against the a limit of a catch of the track, the base sub-assembly flexes and the base moves clear of the rib of the housing.

12. The stapler of claim 11, wherein the base sub-assembly freely slides rearward in the base sub-assembly flexed condition.

13. The stapler of claim 9, wherein in both the first and second base/track sub-assembly positions, the base is limited to a farthest position away from the track in the second base position by a catch of the track that is selectively linked to the base.

* * * * *